United States Patent [19]

Patton

[11] Patent Number: 4,991,840

[45] Date of Patent: Feb. 12, 1991

[54] UNINFLATED TETHERED FOOTBALL PRACTICE KICKING AID

[75] Inventor: John C. Patton, P.O. Box 67, La Pryor, Tex. 78872

[73] Assignees: John C. Patton, La Pryor; R. E. Peppy Blount, Longview, both of Tex.

[21] Appl. No.: 442,661

[22] Filed: Nov. 29, 1989

[51] Int. Cl.[5] ..... A63B 67/00

[52] U.S. Cl. ..... 273/55 B; 273/65 EE; 273/65 R

[58] Field of Search ..... 273/55 B, 58 C, 185 C, 273/DIG. 9, 65 R, 65 ED, 65 EE, 199 R, 65 EC

[56] References Cited

U.S. PATENT DOCUMENTS

| | | | |
|---|---|---|---|
| 3,227,450 | 1/1966 | Pruitt | 273/55 B |
| 3,525,523 | 8/1970 | Bellagamba et al. | 273/55 B |
| 3,729,194 | 4/1973 | Barnett | 273/55 B |
| 3,884,466 | 5/1975 | McDonald et al. | 273/65 EE |
| 4,003,574 | 1/1977 | McDonald et al. | 273/65 EE |
| 4,350,338 | 9/1982 | May | 273/55 B |

OTHER PUBLICATIONS

Plastic World, Oct. 1985, pp. 32, 33.

*Primary Examiner*—Theatrice Brown
*Attorney, Agent, or Firm*—Peter J. Georges

[57] ABSTRACT

A football fabricated of a specific injection molded thermoplastic polyester elastomer is described. A tethered football practice kicking aid, comprised of a tether, stakes and the described football with holes therein through which the tether is passed is also described. The injection molded thermoplastic polyester elastomer has a flexural modulus of 117 MPa [17,000 psi], a nominal durometer hardness of 470, a melt flow rate of 5.5 g/min., a melting point at peak of endotherm of 208° C. and at the extrapolated end point of 225° C., a compression set after 22 hours at 70° C. [158° F.] 2.8 MPa [400 psi] load of 2 and a specific gravity of 2.

1 Claim, 1 Drawing Sheet

Fig. 1
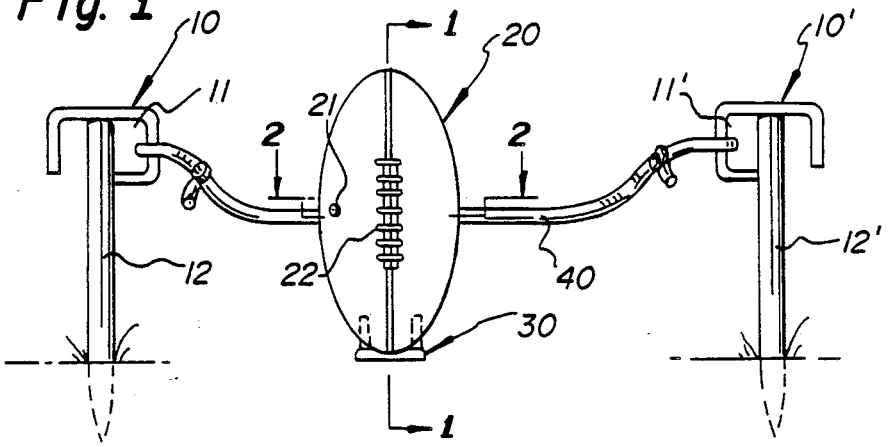
Fig. 2
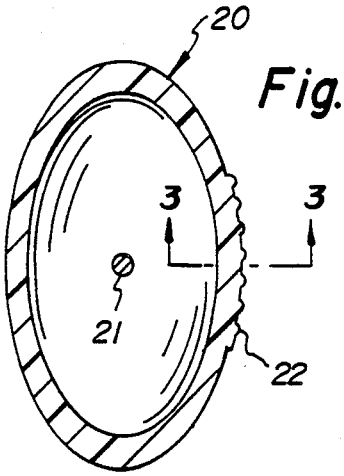
Fig. 3
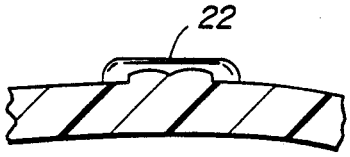
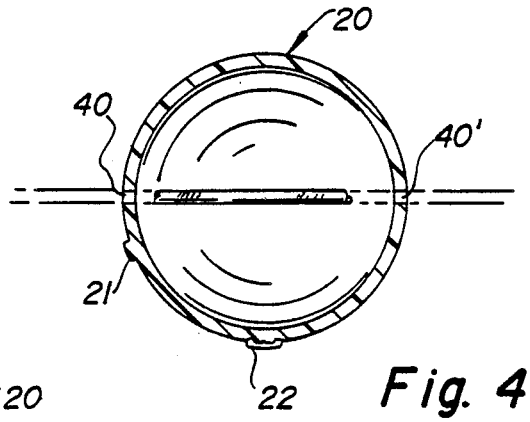
Fig. 4
Fig. 5
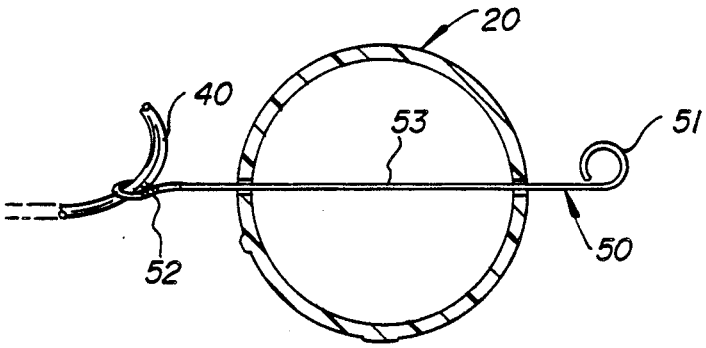

UNINFLATED TETHERED FOOTBALL PRACTICE KICKING AID

FIELD OF THE INVENTION

The present invention relates to a football fabricated using a specific thermoplastic polyester elastomer. The football replicates the characteristics of a regulation leather football. The football of the present invention does not require inflation to maintain its shape and/or the characteristics of its play. A tethered football practice kicking aid, which utilizes the characteristics of the uninflated football to advantage is described.

SUMMARY OF THE INVENTION

As noted above the invention relates to a football composed of a specific thermoplastic polyester elastomer. The use of such elastomer provides a football which has been found to replicate the characteristics of a regulation leather football. The football of the present invention is not required to be pressurized in order to maintain its shape and/or the characteristics of its play. No bladder and/or valve is required in its construction.

The football finds particular advantage in a tethered football practice kicking aid.

A key element of the present invention is the selection of a material that, when formed in the configuration of a football, replicates the characteristics of leather footballs which invariably are inflated and under pressure. The football of the present invention can be characterized as airless and non-inflatable.

In accordance with applicant's invention, the football is constructed of thermoplastic polyester elastomer, specifically the polyester sold under the brand name HYTREL G-4784, a thermoplastic polyester elastomer and a product of The DuPont Company.

HYTREL G-4784 is a thermoplastic polyester elastomer designed for blow molding or processing by other techniques requiring high melt viscosities. HYTREL G-4784 has a nominal durometer hardness of 47D and a flexural modulus of 117 MPa [17,000 psi]. It contains a discoloring antioxidant which affords excellent heat aging resistance. The flexibility of HYTREL polyester elastomer is intermediate between that of rubber and engineering plastics.

The physical properties of HYTREL are set forth in the table below.

TABLE I

Physical Properties of Hytrel ® G-4784 (Injection Molded Test Pieces)

| Property | ASTM Test | Units | Typical[a] |
|---|---|---|---|
| Hardness, Durometer D | D 2240 | Points | 47 |
| Processing | | | |
| Melt Flow Rate at 230/2.16 | D 1238 | g/10 min | 5.5 |
| Melting Point | D 3418[b] | °C. [°F.] | |
| Peak of Endotherm | | | 208 [406] |
| Extrapolated End Point | | | 225 [437] |
| Stress-Strain | | | |
| Tensile Strength[c] | D 638 | MPa [psi] | 19.1 [2 770] |
| Elongation at Break[c] | D 638 | % | 250 |
| Stress at 5% Strain[d] | D 638 | MPa [psi] | 4.9 [710] |
| Stress at 10% Strain[d] | D 638 | MPa [psi] | 7.3 [1 060] |
| Stiffness | | | |
| Flexural Modulus: | D 790 Method I, Procedure B | MPa [psi] | |
| at −40° C. [−40° F.] | | | 200 [29 000] |
| at 23° C. [73° F.] | | | 128 [18 600] |
| at 100° C. [212° F.] | | | 76 [11 000] |
| Brittleness Temperature, Solenoid | D 746 | °C. [°F.] | −66 [−86.8] |
| Toughness | | | |
| Initial Tear Resistance, Die C | D 1004[e] | kN/m [lbf/in] | 89 [510] |
| | D 624[e] | kN/m [lbf/in] | 73 [415] |
| Izod Impact (Notched) | D 256 Method A | | |
| at −40° C. [−40° F.] | | J/cm [ft · lbf/in ] | NB |
| at 23° C. [73° F.] | | J/cm [ft · lbf/in] | NB |
| Resistance to Flex Cut Growth, Ross (Pierced) | D 1052 | Cycles to 500% Cut Growth | $>1 \times 10^6$ |
| Abrasion Resistance | | | |
| Taber, CS-17 wheel, 1 kg load | D 1044 | mg/1 000 cycles | 18 |
| Taber, H-18 wheel, 1 kg load | D 1044 | mg/1 000 cycles | 200 |
| Miscellaneous | | | |
| Compression Set, after 22 h at 70° C. [158° F.] | | | |
| 2.8 MPa [400 psi] load | D 395A | % | 2 |
| Specific Gravity | D 792 | — | 1.20 |
| Water Absorption (24 h) | D 570 | % | 2.5 |
| Softening Point, Vicat | D 1525 | °C. [°F.] | 174 [354] |
| Heat Deflection Temperature | D 648 | | |
| 0.5 MPa [66 psi] | | °C. [°F.] | 76 [169] |

TABLE I-continued

| Physical Properties of Hytrel ® G-4784 (Injection Molded Test Pieces) | | | |
|---|---|---|---|
| Property | ASTM Test | Units | Typical[a] |
| 1.8 MPa [264 psi] | | °C. [°F.] | 43 [109] |

[a]These are values for HYTREL ® G-4784 based on our experience to date. They are subject to change as additional data are accumulated and statistically treated. Colorant or additives of any kind may alter some or all of these properties. Processing conditions may also influence properties. The data listed here fall within the normal range of product properties, but they should not be used to establish specification limits or used alone as the basis of design.
[b]Differential Scanning Calorimeter
[c]Head Speed 50 mm/min [2 in/min]
[d]Head Speed 25 mm/min [1 in/min]
[e]Specimens 2 mm [0.075 in] thick It is essential, in accordance with the present invention, that the uninflated football of regulation weight and size be fabricated from a thermoplastic polyester substantially as described in Table I of the specification.

The football may be manufactured using blow molding techniques. Blow molding methods of manufacture and mold architectures are features that are well known in the art and are not a part of the present invention. It should be added, however, that is is believed that the injection/blow molding technique provides an unpressurized football that corresponds remarkably in weight, feel and performance with the regulation footballs used in professional and amateur football.

Regarding the mold, its surface may be acid etched to impart a dimpled outer surface with etching suitably to 1/32 inch depth providing for an appropriate pebbled finish on the surface of the blow molded football. The four segments/panels which typically are sewn together to achieve the shape of the football and the indentations and lacing of the football are replicated by fashioning the mold to form the desired features.

The laces are replicated by providing raised portions on the molded football of about ⅛ inch corresponding to the configuration of laces on regulation leather footballs. The blow hole/injection hole typically is located to appear on the blow molded football as a replica of the valve stem opening of a regulation football.

The practice kicking aid comprises an uninflated football of regulation weight and size fabricated from a thermoplastic polyester elastomer sold by the DuPont Company under the mark HYTREL G-4784, the uninflated football has an outer appearance replicating the features of a regulation leather football. The uninflated football has a pebbled surface textured, lacing, two top panels on either side of the lacing and two bottom panels. The panels are delineated by an indentation on the surface of the uninflated football. The indentations correspond to those of a regulation leather football and formed where the panels of same are sewn together. The indentations run the length of the football. The uninflated football further has two opposing openings bisecting respectively the two indentations running the length of the football and delimiting the top panels on either side of the lacing from the bottom two panels. The openings being centrally located along the length of the football. The openings are equidistant from each end of the football. The other part of the kicking aid is a tether line which passes through the uninflated football. The tether line enters at one of the openings and exits from the other. The tether line extends out from either side of the uninflated football. The lengths of the tether line which extend out from either side of the football are substantially equal. In use, the ends of the tether line are secured a predetermined distance apart from each other. Accordingly, in accordance with the present invention, means are provided to secure the tether line. The means for securing the ends of the tether lines may be stakes, suitably stakes that are barbed.

One embodiment of the present invention involves a kicking practice football which has openings centrally located along the length of the football, preferably centered on the indentations delineating the two top panels on either side of the lacing from the two bottom panels.

The openings are suitably formed after blow molding. This sequencing of manufacture simplifies the mold utilized and therefore facilitates the formation of a substantially even surface internally. In this manner, by injecting 14.5 oz. of liquid HYTREL brand polyester elastomer into the mold an even thickness of about 3/16 inch for each panel is achieved. A ball of regulation weight (14.5 oz.) having the bounce and play of a traditional leather ball is produced.

The holes can be formed in the football after molding. In the regulation football, the holes are of a size to accommodate the cord selected. Where a cord suitably of about 3/16 inch in diameter is chosen, holes of about ¼ inch diameter are suitable.

It should be understood that the kicking practice football of the present invention can be downsized to replicate other standard sizes such as the junior size. In the case of a junior size football, holes of smaller diameter than the regulation size football are typically used in order to accommodate a downsized cord, suitably about ⅛ inch in diameter.

In accordance with the present invention, by providing an uninflated football replicating the characteristics of the standard leather inflated football, it is possible to use a staked arrangement which allows practice kicking of the football in a limited area without the use of a kicking net. Recovery of the football by the kicker is facilitated by ball return achieved using a staked cord.

The cord passes through the holes in the football with substantially equal lengths of cord extending out from either side of the football.

The cord suitable for use in the present invention can be selected from any number of flexible cords commerically available. It may suitably be fabricated from natural material of synthetic fibers. One source of suitable cord/rope for the present invention is Hope Webbing, 1005 Main Street of Pantucket, R.I. The tether cord used with particular success is HOPE STYLE #2501 POLYPROPYLENE SHOCK CORD which is a cord comprised of a natural rubber core with a braided polypropylene cover. The cover selected is preferably of lightweight, with the only critical requirement being that it is able to withstand the forces generated when the kicked football is stopped in flight without breaking.

The cord is passed through the football entering one of the openings of the football and exiting through the other opposed opening. A needle having a length exceeding the football width and an eye that can pass through the openings can be used to facilitate running the cord through the football.

The ends of the cord are affixed to separate cord retaining members. The means of retaining the cord are suitably situated about six feet apart. The kicker stands substantially equidistant from each of the cord retaining means. Where the kicker is warming up and practice kicking from tee, the ball will be aligned from about 6 to about 8 feet behind an imaginary line extending between the cord retaining means. The football, when kicked, rebounds and is available for replacement on the tee after each kick.

Here, again, is should be emphasized that a critical feature of the present invention is the use of the specific polymer identified herein, which allows the teed uninflated recoverable football with rope passed therethrough to replicate the characteristics of a standard inflated regulation leather football at the time of impact during kicking of the football.

BRIEF DESCRIPTION OF THE DRAWINGS

FIG. 1 is a perspective view of the embodiment of the invention comprising the staked football illustrated as supported on a kicking tee.

FIG. 2 is a sectional view taken along 1—1 of FIG. 1.

FIG. 3 is a partial section view taken along 3—3 of FIG. 2.

FIG. 4 is sectional view taken along 1—1 of FIG. 1 illustrating tether cord placement.

FIG. 5 is a sectional view taken along 1—1 of FIG. 1 illustrating the use of a needle like instrument to pass the tether through the football of the present invention.

DETAILED DESCRIPTION OF THE INVENTION

As heretofore noted, the rope/cord ends are secured. For this purpose, stakes may be used and it has been found that tent-type stakes are suitable for this purpose. The stakes (10, 10') illustrated in FIG. 1 have eyes (11, 11') for rope attachment and optionally the smooth stake illustrated may be barbed. The barbs prevent/resist withdrawal. The use of multiple projections (barbs) extending backward from the point of the stake to prevent withdrawal is preferred, where short stakes of 7" or less are used. The stakes may be metal, plastic or of other construction and the posts (12, 12') can be of the same or different material than the material forming eyes (11, 11') of the stakes. For the plastic stakes, polyethylene is suitable. Weighted retaining means with an eye or other means by which a cord can be affixed are also suitable and indeed one could use appropriately spaced trunks of trees or other outcroppings or objects for affixation, provided only that the ball trajectory is not impeded and the points of affixation are appropriatly spaced.

Referring further to FIG. 1, football 20 is shown supported on tee 30 and tethered to stakes 10, 10' by tether cord 40. The football is fabricated from the thermoplastic elastomer defined in Table I.

FIG. 2, a sectional view of the football 20 taken along 1—1 of FIG. 1, illustrates positioning of the blowhole 21 that, as shown, is located to replicate the valve of a regulation inflatable football.

FIG. 3 shows the replicas of lacing (22) on the football in partial section view taken along 3—3 of FIG. 2.

FIG. 4, a sectional view of football 20 is shown, illustrating holes 40, 40' on opposing sides of the football through which tether line 20 is passed.

In FIG. 5, also a sectional view along 1—1 of FIG. 1, a needle like instrument 50, having a cord engaging end 52, elongated rod portion 53 and handle end 51, is shown in the process of being passed through football 20 carrying therewith cord 40 engaged by engaging end 52.

The detailed description set forth is the preferred embodiment of the present invention and various changes and alterations can be made without departing from the spirit and broader aspects of the invention. it is not intended to limit the invention to the details heretofore, recited, the invention being defined by the claims which follow.

I claim:

1. In a football device for kicking practice comprising (1) a football of regulation size and weight and (2) tether means for said football comprising two spaced apart stakes and two segments of rope of relatively equal length connecting said stakes with said football, said segments of the rope extending outwardly from opposed sides of the football and being oppositely spaced apart, the improvement comprising using as said football, a football fabricated from injection molded thermoplastic polyester elastomer having a flexural modulus of about 117 MPa, a nominal durometer hardness of about 470, a melt flow rate of about 5.5 g/min., melting point at peak of endotherm of about 208° C. and at the extrapolated end point of about 225° C., a compression set after 22 hours at 70° C., 2.8 MPa load of about 2 and a specific gravity of about 2; said football having two opposing openings through which a rope is passed; said rope, after passing through said holes, forming said two segments of rope of relatively equal length extending outwardly from said football and connecting said stakes with said football.

* * * * *